United States Patent [19]

Wunner

[11] Patent Number: 4,754,617

[45] Date of Patent: Jul. 5, 1988

[54] WARP KNIT FABRIC WITH PILE LOOPS AND THE PROCESS OF PRODUCING SAME

[75] Inventor: Roland Wunner, Schwarzenbach, Fed. Rep. of Germany

[73] Assignee: Liba Maschinenfabrik GmbH, Naila, Fed. Rep. of Germany

[21] Appl. No.: 943,638

[22] Filed: Dec. 18, 1986

[30] Foreign Application Priority Data

Dec. 23, 1985 [DE] Fed. Rep. of Germany ..... 3545791

[51] Int. Cl.[4] ..... D04B 7/12

[52] U.S. Cl. ..... 66/194

[58] Field of Search ..... 66/194, 193, 84 R, 85 R

[56] References Cited

U.S. PATENT DOCUMENTS

| | | | |
|---|---|---|---|
| 2,435,897 | 2/1948 | Newman | 66/193 |
| 2,993,353 | 7/1961 | Grau | 66/84 |
| 3,727,433 | 4/1973 | Hamano | 66/84 R |
| 3,845,641 | 11/1974 | Waller | 66/193 |
| 3,866,443 | 2/1975 | Hunneke | 66/194 |
| 4,003,222 | 1/1977 | Wunner | 66/84 R |
| 4,338,800 | 7/1982 | Matsuda | 66/196 |
| 4,463,486 | 8/1984 | Matsuda | 66/196 |

FOREIGN PATENT DOCUMENTS

| | | | |
|---|---|---|---|
| 1189336 | 6/1985 | Canada | 66/194 |

OTHER PUBLICATIONS

Darlington, K. D., "Analysis of Tricot Velour Fabrics" Knitting Times, Feb. 16, 1976, vol. 45, No. 7, pp. 33 to 37.

Mayer, 56 Wirkpost, 1985 Melliand Textilberichte, 6/1975.

Wirkerei-und Strickerei-Technik 34(1984), Melliand Textilberichte, 5/1984.

*Primary Examiner*—Ronald Feldbaum

*Attorney, Agent, or Firm*—Dority & Manning

[57] ABSTRACT

Process for the production of a warp knit fabric with a basic material including a tricot stitch ground and a chain stitch ground as well as a pile laid over pile sinkers, forming pile loops which are knitted into the material. The pile sinkers are offset relative to their pile sinker bar by one needle division per stitch row so that the tricot ground can be formed. The chain stitch ground yarns form a loop only every other stitch row so that the looping is let out in the formation of the chain stitch ground once the yarn which forms the chain stitch ground has been displaced laterally by the pile sinker bar.

4 Claims, 2 Drawing Sheets

WARP KNIT FABRIC WITH PILE LOOPS AND THE PROCESS OF PRODUCING SAME

BACKGROUND OF THE INVENTION

A warp knit fabric is known in which additional pile loops are knit into a basic material consisting of a tricot stitch ground and a chain ground, and in which the pile loops themselves are constituted by a laying of chain stitches.

In order to make this possible with the tricot yarn being laid in the material when pile loops must additionally be formed by pile sinkers, a further development is known from U.S. Pat. No. 4,003,222 whichis the U.S. counterpart of German patent No. 24 35 312, consisting of offsetting the pile sinkers by one needle division per stitch row so that the tricot yarn can be laid down. This prevents the tricot yarns from being laid over the pile sinkers.

To lay the chain stitches for the warp knit fabric mentioned initially, the shifting of the pile sinker bar creates a problem when the chain yarns are laid over the pile sinkers and would, thus, form pile in an undesirable manner. To avoid this, the pile sinkers are inserted into the pile sinker bar so that, for the production of the known warp knit fabric mentioned initially, one pile sinker is provided for only every other needle, i.e. every other needle is removed from the influence of the pile sinker so that, consequently, the formation of the chain stitch ground for the basic material is made possible on that needle. The known warp knit fabric has a basic material in which the chain stitch ground is formed only on every other needle while the chains forming the pile are laid by the next adjoining needle which is not used to make the chain stitch ground. A warp knit fabric is thus produced which does not have a tight pile formation because of the pile gap resulting on every other needle, and which-does, therefore, not possess great longitudinal stability. As stated before, it allows the laying of the chain stitch ground yarns, which produces longitudinal stability, on every other needle only.

SUMMARY OF THE INVENTION

It is the object of the present invention to create a warp knit fabric with a material including a tricot stitch ground and a chain stitch ground, as well as a pile ground, which is characterized by dense pile formation and great longitudinal stability.

This problem is solved by a warp knit fabric with a material which includes a tricot stitch ground and a chain stitch ground as well as pile laid over pile sinkers to form pile loops which are knit into the material. The pile sinkers, together with their pile sinker bar, are offset per stitch row by one needle division to make the laying of the tricot ground possible. The chain stitch ground forms a loop only every other stitch row, so that the formation of loops is omitted in the laying of the chain ground when the yarn constituting the chain stitch ground has been displaced laterally by the pile sinker bar in its offset movement.

By letting out the looping during the laying of the chain ground in every other stitch row, the yarn is prevented from intermeshing when the pile sinker bar, in its offset movement, displaces the yarn which forms the chain stitch ground laterally. This makes it possible for the yarn to tighten up in the longitudinal sense within the material when the pile sinker bar has returned to its initial position. On the other hand, if the pile sinker bar did not displace the yarn which forms the chain stitch ground, the yarn can be used for looping, so that one chain stitch is formed on every needle which is looped in only every other stitch row in the material. This does not affect the longitudinal stability of the knit fabric. However, both pile and chain stitches can be formed on each needle, by means of this particular type of laying the chain stitch yarn, where the pile loops are repeated from stitch row to stitch row, producing the densest possible pile.

BRIEF DESCRIPTION OF THE DRAWINGS

The drawings further explain the invention, in which.

DETAILED DESCRIPTION OF THE INVENTION

Figure 1:
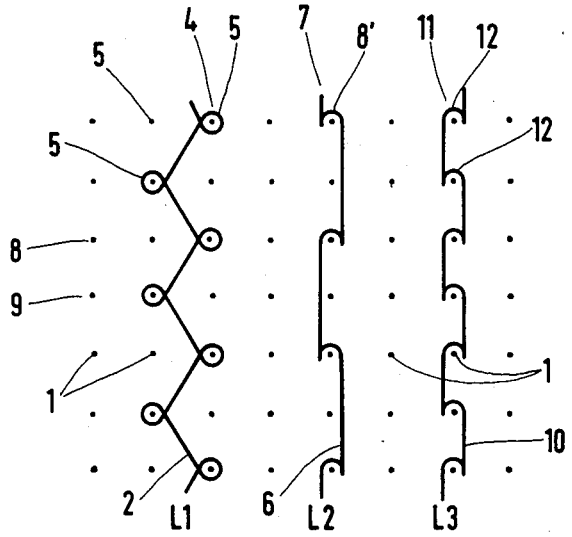
FIG. 1 shows, in conventional schematic representation, the laying of the tricot stitch yarn, the chain stitch yarn and the pile yarn, each one next to the other.

The points 1 shown in FIG. 1, represent the locations of possible looping by the needles of the warp knitting machine. According to FIG. 1, the laying bar L1 lays the tricot yarn 2 in a known manner over two adjoining needles 3 and 4, whereby the loops are formed. Laying bar L2 lays chain stitch yarn 6 over needles 7, whereby every second stitch row forms a loop 8, 8'. Stitch rows are understood to be the successive rows 9 of points 1. Finally, the laying bar L3 lays the pile yarn 10 over needles 11, said yarn forming a loop 12 in every stitch row.

Figure 2:
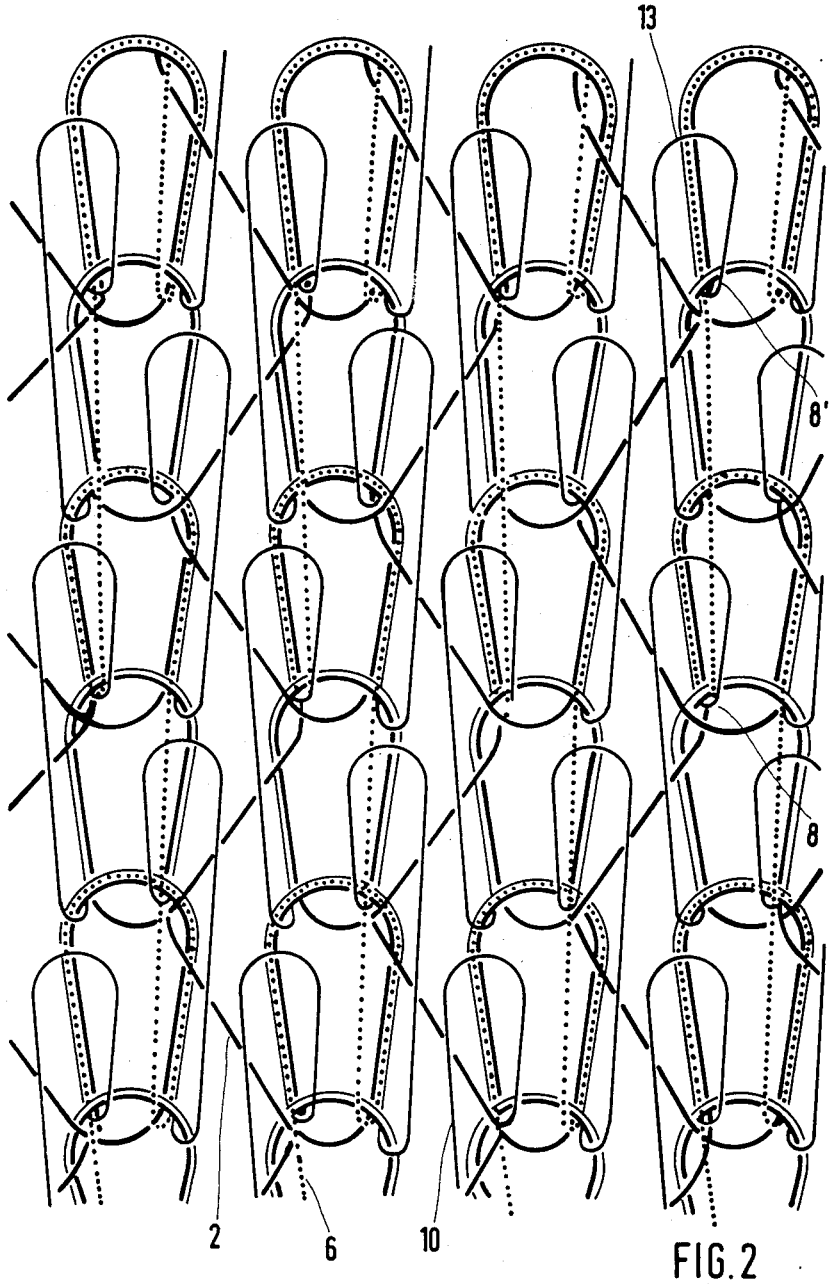
FIG. 2 shows an overall view of the laying of yarn according to FIG. 1.

When the laid yarns, according to FIG. 1, are uninterruptedly distributed over all the needles 3, 4, 7, 11, etc., there results a laying effect as shown in the fabric of FIG. 2. In FIG. 2 (which shows the yarns of FIG. 1), the tricot stitch yarns (thick lines) are identified with the number 2, the chain stitch yarns (dotted lines) with the number 6, and the pile yarns (thin lines) with number 10. The pile loops are identified with the number 13. For every offset pile sinker the chain yarn 6 is not looped, while upon return of the pile sinker into its initial position, the chain yarn 6 is tightly looped into loops 8, 8', resulting in great longitudinal stability of the knit fabric.

Figure 3:
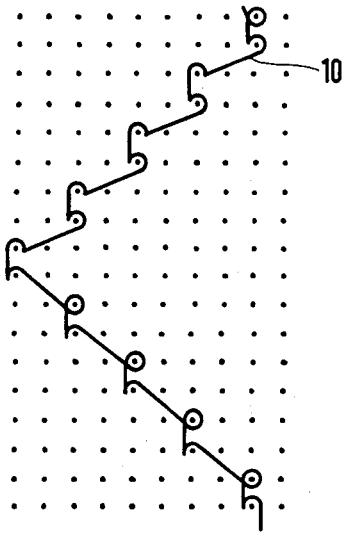
FIG. 3 shows an alternative laying of the pile yarn.

FIG. 3 shows an alternative arrangement where the pile yarn 10 must not only be laid in the chain (see FIGS. 1 and 2), but can also be laid according to a pattern, e.g. as per FIG. 3, in cloth and chain laying steps whereby a loop is formed uninterruptedly in every stitch row.

While an embodiment of the fabric of the invention has been illustrated and described, and a process for producing a warp knit pile fabric has been disclosed as examples of the invention, it is to be understood that the words used are words of description only and are not intended to limit the scope and range of the invention. It is to be understood that the scope and range of the invention is the fullest measure of that provided by the attached claims.

What is claimed is:

1. Process for the production of warp knits with a basic material including a tricot ground stitch and a chain ground stitch as well as a pile layer made over pile sinkers, comprising forming pile loops which are knitted into the material, the pile sinkers being offset in relation to their pile sinker bar by one needle division per stitch row, forming the tricot stitches by laying chain yarns about each of the needles in every other row of stitches and thus forming a loop only every other stitch row, whereby the looping is let out in the formation of the chain ground stitch, once the yarn which forms the chain ground stitch has been displaced laterally by the pile sinker bar.

2. A process for the production of a warp knit pile fabric as set forth in claim 1, wherein said pile yarns are laid in accordance with a predetermined pattern.

3. A warp knit pile fabric, comprising:

(a) a tricot stitch ground comprising a plurality of yarns interknit into a plurality of wales and rows of stitches;

(b) chain stitch yarns interknit to form a chain stitch ground in each wale at every other row of stitches; and (c) pile yarns interknit in each wale on every row of stitches to form pile loops thereat.

4. A warp knit pile fabric as set forth in claim 3, wherein said pile yarns are interknit into said fabric in a predetermined pattern.

* * * * *